US009415954B2

(12) United States Patent
Ukai

(10) Patent No.: US 9,415,954 B2
(45) Date of Patent: Aug. 16, 2016

(54) IMAGE READER AND SHEET FEEDING DEVICE

(71) Applicant: Brother Kogyo Kabushiki Kaisha, Nagoya-shi, Aichi-ken (JP)

(72) Inventor: Shinji Ukai, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,797

(22) Filed: Mar. 27, 2015

(65) Prior Publication Data

US 2015/0274451 A1 Oct. 1, 2015

(30) Foreign Application Priority Data

Mar. 28, 2014 (JP) ..... 2014-069730

(51) Int. Cl.
*B65H 1/02* (2006.01)

(52) U.S. Cl.
CPC ..... *B65H 1/02* (2013.01); *B65H 2405/2111* (2013.01); *B65H 2405/324* (2013.01); *B65H 2407/21* (2013.01); *B65H 2801/39* (2013.01)

(58) Field of Classification Search
CPC ..... B65H 1/02; B65H 2405/354; B65H 2405/324; B65H 2405/2111; B65H 2801/39
USPC ..... 399/125, 377, 392, 393
See application file for complete search history.

(56) References Cited

U.S. PATENT DOCUMENTS

| | | | | |
|---|---|---|---|---|
| 7,872,783 | B2 | 1/2011 | Kitagawa et al. | |
| 8,169,669 | B2 * | 5/2012 | Yoshida | H04N 1/00525 358/400 |
| 8,712,312 | B2 * | 4/2014 | Lee | G03G 21/1633 271/9.09 |
| 8,840,108 | B2 | 9/2014 | Morikawa et al. | |
| 2008/0259414 | A1 | 10/2008 | Kitagawa et al. | |
| 2014/0054851 | A1 | 2/2014 | Morikawa et al. | |

FOREIGN PATENT DOCUMENTS

| | | | |
|---|---|---|---|
| JP | H04-342267 | A | 11/1992 |
| JP | 2008-120498 | A | 5/2008 |
| JP | 2008-270954 | A | 11/2008 |
| JP | 2014-043292 | A | 3/2014 |

* cited by examiner

*Primary Examiner* — Michael McCullough
(74) *Attorney, Agent, or Firm* — Banner & Witcoff, Ltd.

(57) ABSTRACT

A sheet feeder includes a first tray and a second tray. The first tray is movable to a first open position and a second open position. The second tray is movable between a closed position and an open position. When the second tray is in the closed position and the first tray is in the first open position, a first tray surface of the first tray forms a first angle with the chute surface. When the second tray is in the open position and the first tray is in the second open position, the first tray surface is located between the chute surface and a second tray surface of the second tray and forms a second angle with the chute surface, the second angle being smaller than the first angle and the first and second angles are obtuse angles.

16 Claims, 13 Drawing Sheets

ENLARGED VIEW OF REAGION A

ENLARGED VIEW OF REAGION B

ENLARGED VIEW
OF REAGION C

IMAGE READER AND SHEET FEEDING DEVICE

CROSS-REFERENCE TO RELATED APPLICATION

This application is based upon and claims the benefit of priority of Japanese Patent Application No. 2014-069730 filed on Mar. 28, 2014, the contents of which are incorporated herein by reference in its entirety.

BACKGROUND

There exist a sheet feeding apparatuses that are structured as an image scanner and that include a lower housing, an upper housing, and a sheet tray. A feed roller and an image scanning unit are disposed in the lower housing and the upper housing. A sheet placed on the sheet tray is fed by the feed roller, and a surface of the sheet is scanned by the image scanning unit. Moreover, with the sheet feeding apparatus, a card is fed and a surface of the card is scanned.

SUMMARY

Aspects of the present disclosure improve a sheet guiding function in an image processing apparatus. According to some aspects, the image processing includes a sheet feeder with a chute, a first tray and a second tray. The first tray may include multiple open positions while the second tray may be opened and closed. According to further aspects, the configuration between the first tray, the second tray and the chute allow for various types of media to be fed and processed through the apparatus.

DETAILED DESCRIPTION

Figure 1:
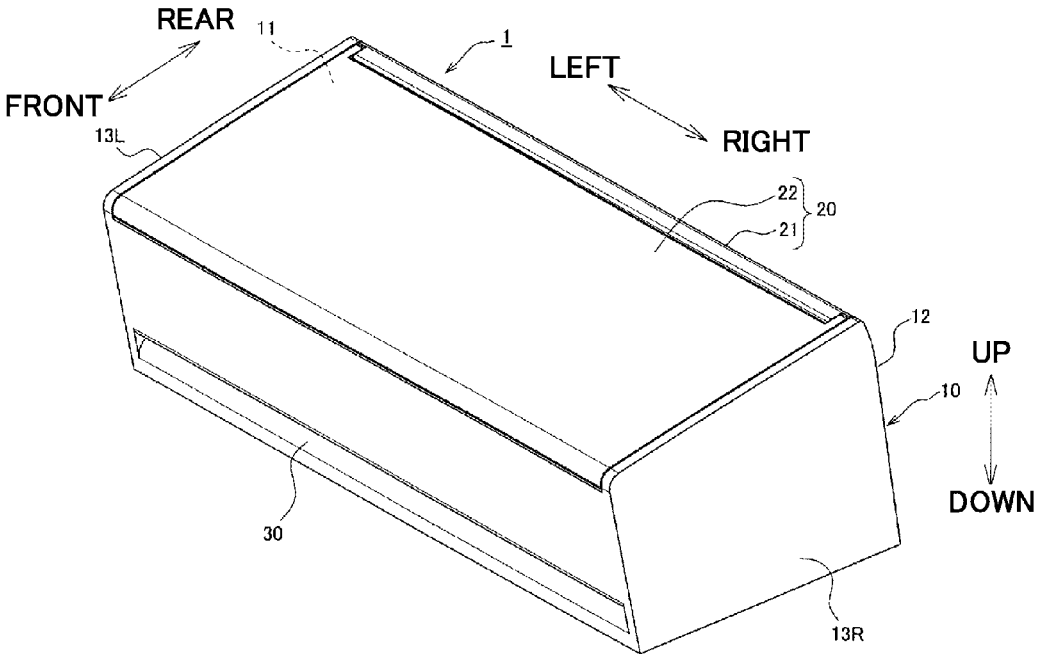
FIG. 1 is a perspective view of an image scanner according to an example embodiment in a state in which a first tray and a second tray are closed.

In order to reduce the size of a sheet feeding apparatus, a sheet tray may be configured to rotate between an open position and a closed position. A sheet or a card can be placed on the sheet tray in the open position. The sheet tray contacts the upper housing from above in the closed position. In one example, the sheet tray is in the open position regardless of whether the sheet tray supports a sheet or a card, the card being smaller than a sheet. Thus, a large space is needed even when scanning a card, because it is necessary to locate the sheet tray, which is sized so as to be capable of supporting a sheet larger than a card, in the open position.

According to further aspects of the present disclosure may provide a sheet feeder for reducing a space needed for scanning a card, which may be smaller than a sheet.

Hereinafter, example embodiments of the present disclosure will be described with reference to the drawings. The present disclosure is not limited to the embodiments described below and can be implemented in various ways and/or with various modifications.

1. Structure of Image Scanner 1

In the following description, the directions shown by arrows in the drawings (up, down, left, right, front, and back) will be used in order to describe positional relationships between components of an image scanner 1.

Figure 2:
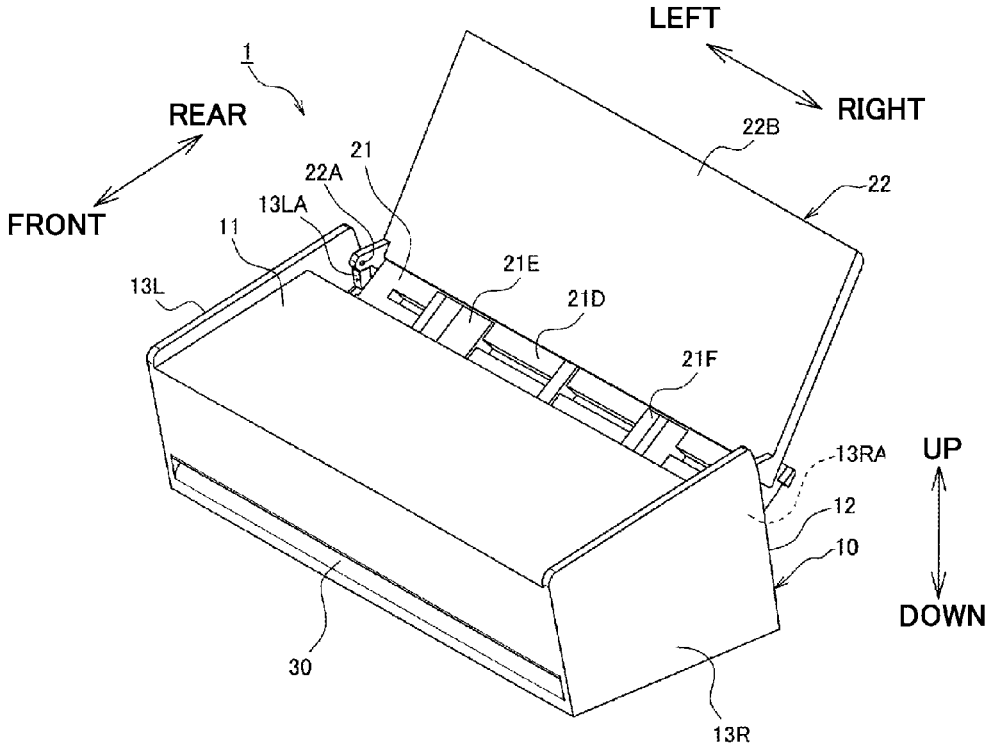
FIG. 2 is a perspective view of the image scanner according to the example embodiment in a state in which the first tray and the second tray are open.
Figure 3:
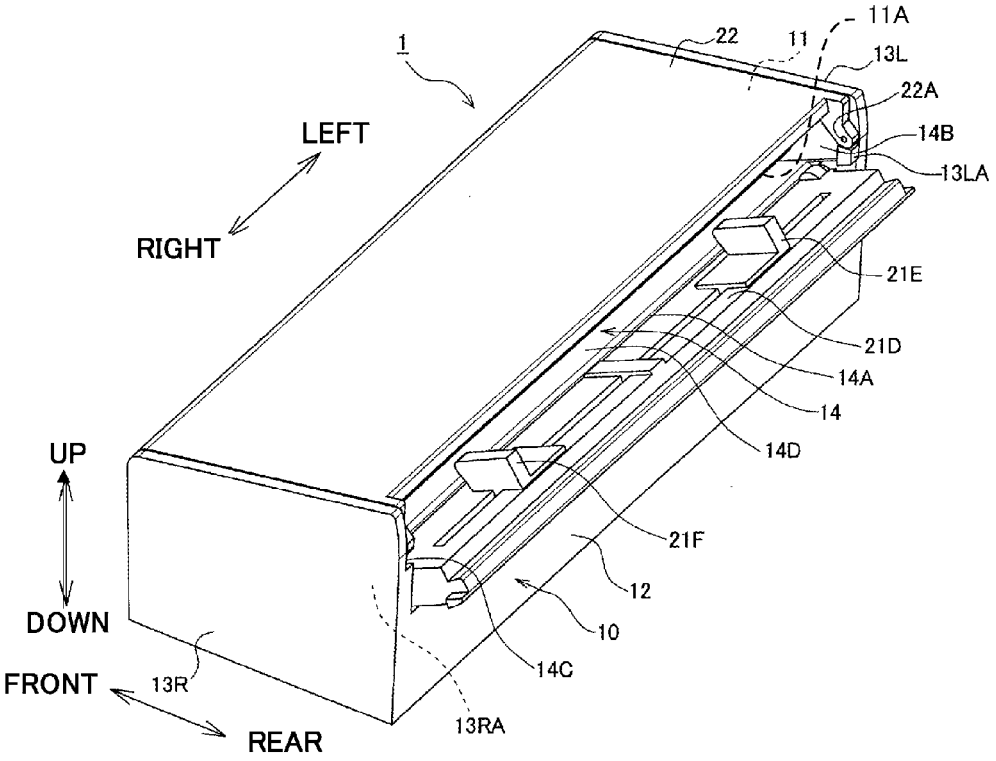
FIG. 3 is a perspective view of the image scanner according to the example embodiment in a state in which the first tray is open and the second tray is closed.
Figure 4:
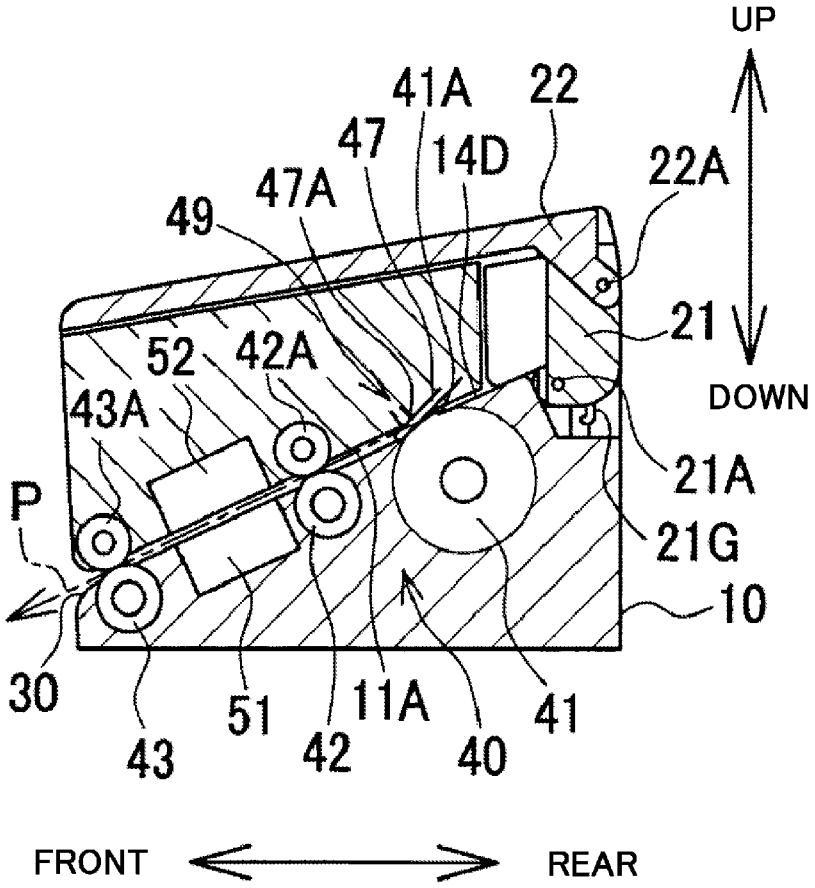
FIG. 4 is a side sectional view of the image scanner according to the example embodiment in a state in which the first tray and the second tray are closed.
Figure 5:
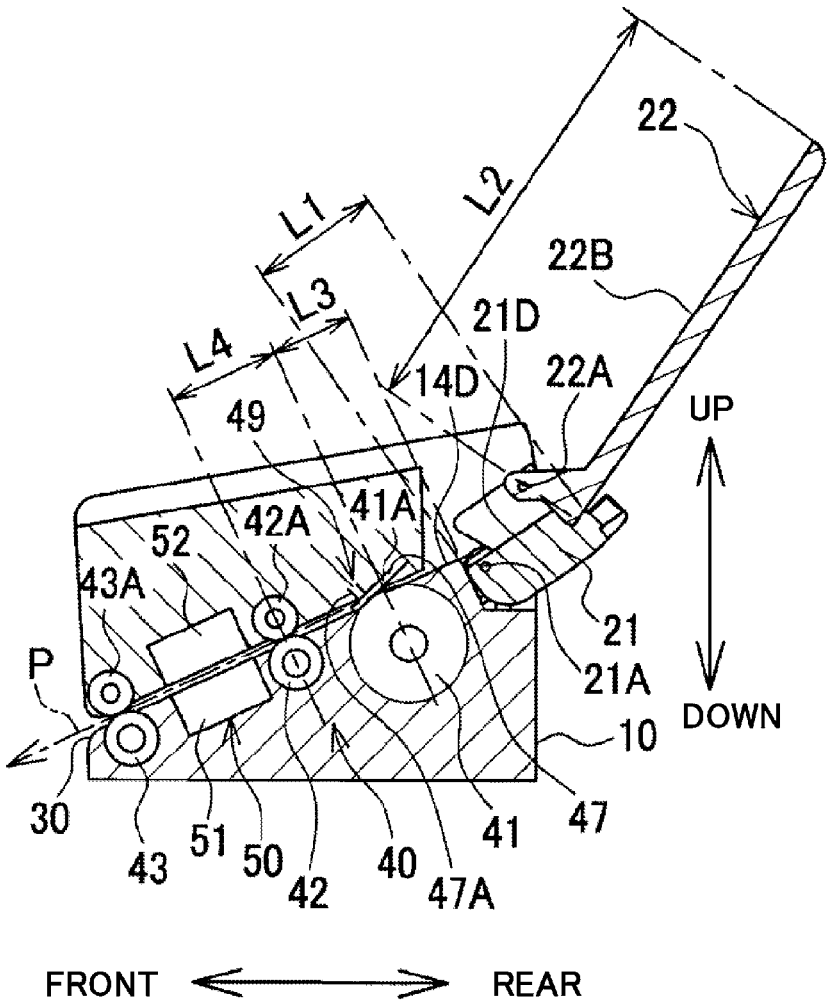
FIG. 5 is a side sectional view of the image scanner according to the example embodiment in a state in which the first tray and the second tray are open.
Figure 6:
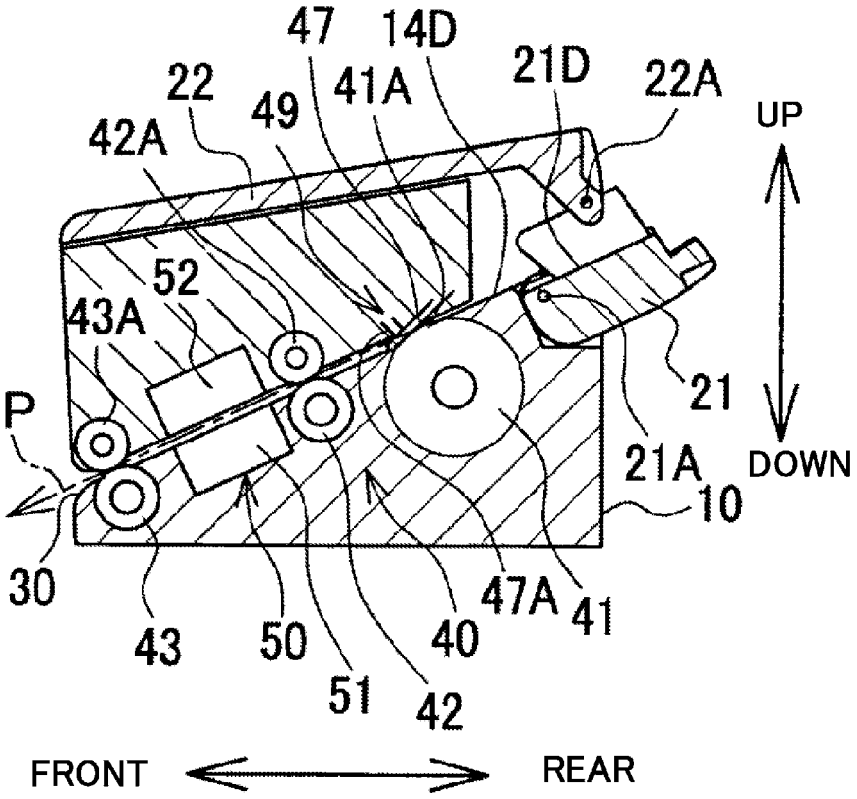
FIG. 6 is a side sectional view of the image scanner according to the example embodiment in a state in which the first tray is open and the second tray is closed.

As illustrated in FIGS. 1 to 3, a sheet feeder such as the image scanner 1 includes a housing 10, a feed tray 20, and an output section 30. As illustrated in FIGS. 4 to 6, a conveyance path P, along which a sheet S is fed from the feed tray 20 to the output section 30, is formed in the housing 10. The image scanner 1 includes a conveyance mechanism 40, an image scanning unit 50, and a power unit (not shown), which are disposed in the housing 10.

1.1. Structure of Housing 10

As illustrated in FIGS. 1 to 3, the housing 10 has a box-like shape and includes an upper cover 11, a back cover 12, left and right side covers 13L and 13R, and an inner frame, where the inner frame is covered by these covers 13L and 13R. The inner frame is made by assembling together a chute 14, a frame member (not shown), and the like. The chute 14 is mounted in the housing 10. The chute 14 is disposed between the side cover 13L and the side cover 13R. The chute 14 is disposed on a front side of the back cover 12. The conveyance path P is defined between upper cover 11 and the chute 14. The chute 14 guides a fed sheet or card along the conveyance path P.

The upper cover 11 is rotatable between an open position, in which the upper cover 11 is located away from the chute 14, and a closed position in which the upper cover 11 is located near (or closer to) the chute 14. When a sheet jam occurs or when maintenance is performed, the upper cover 11 is swung so that a back end thereof is lifted, and the upper cover 11 is separated in an upward direction from the chute 14.

A second tray stopper 13LA is formed in a back part of the side cover 13L. A second tray stopper 13RA is formed in a back part of the side cover 13R.

The chute 14 includes a conveyance guide 14A and side wall portions 14B and 14C. The conveyance guide 14A has a flat plate-like shape and is disposed between the side wall portions 14B and 14C. The conveyance guide 14A extends in the left-right direction and diagonally downward from the back side of the housing 10 to the output section 30. As illustrated in FIG. 3, an upper surface of the conveyance guide 14A faces an upper guide surface 11A of the upper cover 11 from below. The side wall portion 14B is connected to the side cover 13L. The side wall portion 14C is connected to the side cover 13R. The upper surface of the conveyance guide 14A includes a lower guide surface 14D. The lower guide surface 14D and the upper guide surface 11A define the conveyance path P therebetween, when the upper cover 11 is in the closed position. The lower guide surface 14D is an example of a chute surface. When the image scanner 1 is placed horizontally, the lower guide surface 14D forms an inclination angle in the range of, for example, 20 to 30 degrees with a horizontal plane. In one arrangement, the inclination angle is 25 degrees.

1.2. Structure of Feed Tray 20

The feed tray 20 includes a first tray 21 and a second tray 22.

As illustrated in FIGS. 1 to 6, the first tray 21 is attached to the back end of the housing 10 so as to be rotatable around a first rotation axis 21A, which extends in the left-right direction. The first tray 21 and the housing 10 have a first rotation shaft and bearing (not shown). The extending direction of the first rotation shaft defines the first rotation axis 21A. Thus, the first tray 21 can rotate around the first rotation axis 21A in a range from a first closed position, through a second open position, and to a first open position. When the first tray 21 is in the first closed position, which is illustrated in FIGS. 1 and 4, a first tray surface 21D (described below) is located near the back end of the housing 10. When the first tray 21 is in the first open position, which is illustrated in FIGS. 3 and 6, the first tray surface 21D is located away from the back end of the upper cover and continuous with the back end of the chute 14. When the first tray 21 is in the second open position, which is illustrated in FIGS. 2 and 5, the first tray surface 21D is located away from the back end of the housing 10 and is disposed between and continuous with the chute 14 and the second tray 22 in an open position. The open position of the second tray 22 will be described below.

Figure 11:
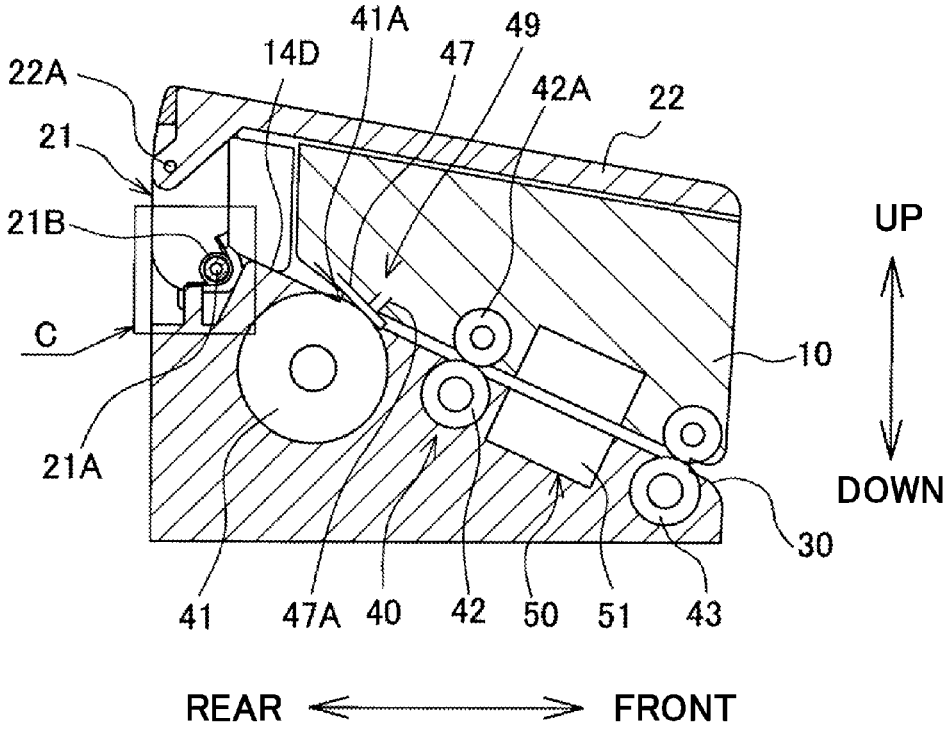
FIG. 11 is a side sectional view of the image scanner according to the example embodiment.
Figure 12:
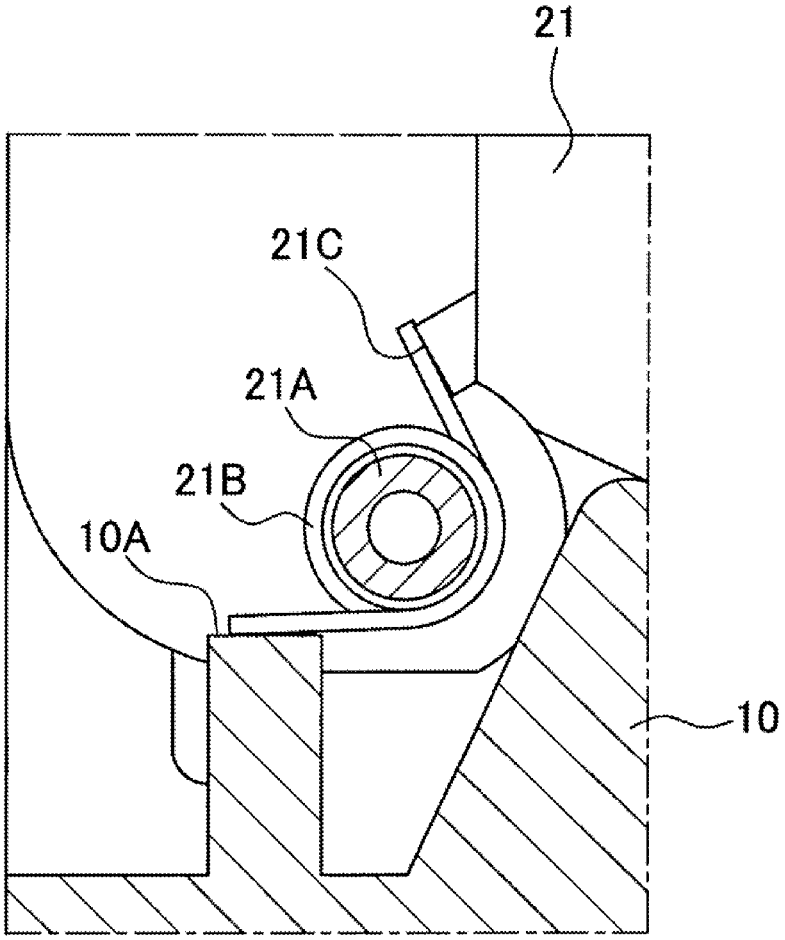
FIG. 12 is an enlarged view of region C of FIG. 11.

As illustrated in FIGS. 11 and 12, a torsion spring 21B is fitted onto the first rotation shaft. One end of the torsion spring 21B is in contact with a contact surface 10A of the housing 10, and the other end of the torsion spring 21B is in contact with a contact surface 21C of the first tray 21. Due to a biasing force of the torsion spring 21B, the first tray 21 is biased from the first open position toward the first closed position. Due to the biasing force of the torsion spring 21B, when the first tray 21 is in the second open position, the first tray 21 is in contact with the second tray 22 in the open position.

As illustrated in FIGS. 2 to 6, a surface of the first tray 21 that faces upward when the first tray 21 is in the first open position or the second open position is the first tray surface 21D for supporting a sheet S. When the first tray 21 is in the first open position, the first tray surface 21D forms an inclined surface that is continuous with the lower guide surface 14D of the chute 14. Side guides 21E and 21F are attached to the first tray surface 21D. The side guide 21E and 21F are example of a first side guide and second side guide.

The side guides 21E and 21F are disposed with a space therebetween in the left-right direction. Each of side guides 21E and 21F has a rack (not shown) extending in the left-right direction. A pinion gear is provided in the first tray 21. The side guides 21E and 21F can be slid along the first tray surface 21D in the left-right direction with each rack engaging the pinion gear. The side guides 21E and 21F are configured to be simultaneously slid in opposite directions.

As illustrated in FIGS. 7 to 10, the first tray 21 includes an engagement protrusion 21G. The engagement protrusion 21G includes an extension portion 21H and an end portion 21I. In one example, the extension portion 21H and the end portion 21I form a first engaging member. The extension portion extends from the first tray 21. The end portion 21I extends forward from a lower end of the extension portion 21H.

Figure 8:
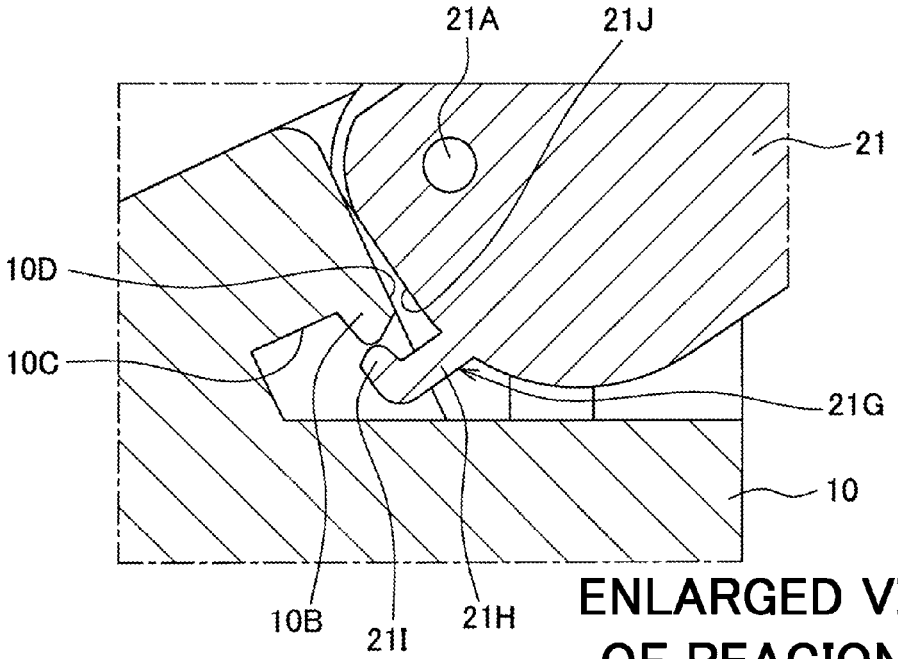
FIG. 8 is an enlarged view of region A of FIG. 7.

As illustrated in FIG. 8, when the first tray 21 is rotated from the first closed position and is in the second open position, the end portion 21I is in contact with a second engaging member such as an engagement protrusion 10B of the housing 10.

Figure 10:
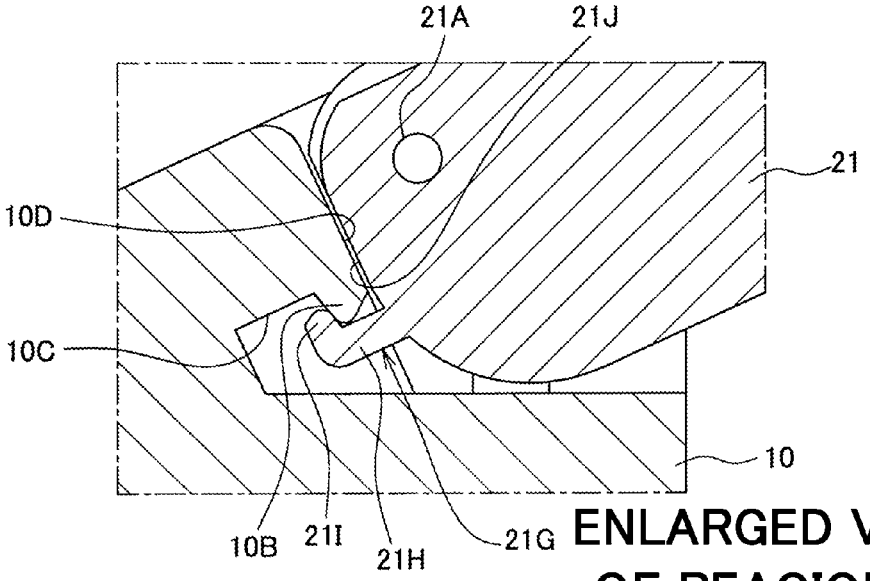
FIG. 10 is an enlarged view of region B of FIG. 9.

When the first tray 21 is rotated from the second open position to the first open position, the end portion 21I is pressed by the engagement protrusion 10B in the radial direction of the first rotation shaft. As illustrated in FIG. 10, when the end portion 21I is pressed, the end portion 21I enters an engagement recess 10C. The engagement recess 10C is formed in the vicinity of the engagement protrusion 10B and is recessed toward the lower guide surface 14D of the chute 14. The end portion 21I, upon entering the engagement recess 10C, becomes engaged with the engagement recess 10C. For example, the end portion 21I protrudes toward the lower guide surface 14D of the chute 14.

When the first tray 21 is moved to the first open position, a lower end surface 21J of the first tray 21 contacts a contact surface 10D of the housing 10. When the end portion 21I is engaged with the engagement recess 10C and the lower end surface 21J is in contact with the contact surface 10D, rotation of the first tray 21 beyond the first open position is restricted. As a result, when the end portion 21I is located in the engagement recess 10C, the position of the first tray 21 is fixed.

As illustrated in FIGS. 1 to 6, the second tray 22 is attached to an upper part of the back end of the housing 10 so as to be rotatable around a second rotation axis 22A, which extends in the left-right direction. The second tray 22 and the housing 10 have a second rotation shaft and bearing (not shown). The extending direction of the second rotation shaft defines the first rotation axis 22A. The second tray 22 is rotatable until the second tray 22 contacts the second tray stoppers 13LA and 13RA. When the second tray 22 is in contact with the second tray stoppers 13LA and 13RA, the second tray 22 is in an open position. Thus, the second tray 22 can rotate around the second rotation axis 22A in a range from a closed position to the open position. As illustrated in FIGS. 1 and 4, when the second tray 22 is in the closed position, the second tray 22 is located near an upper surface of the housing 10. As illustrated in FIGS. 2 and 5, when the second tray 22 is in the open position, the second tray 22 is located away from the upper surface of the housing 10 and continuous with the chute 14 and the back end of the first tray 21. As illustrated in FIG. 5, when the second tray 22 is in the open position and the first tray 21, which is biased from the first open position toward the first closed position, is in contact with the second tray 22, the first tray 21 is in the second open position. In some examples, the biasing force, with which the first tray 21 is biased from the first open position toward the first closed position, is not large enough to move the second tray 22 from the open position toward the closed position.

The second tray 22 is attached to the housing 10 at a position above a position at which the first tray 21 is attached to the housing 10. For example, the position of the second rotation axis 22A, around which the second tray 22 rotates, may be above the position of the first rotation axis 21A, around which the first tray 21 rotates.

A surface of the second tray 22 that faces upward when the second tray 22 is in the open position is a second tray surface 22B for supporting a sheet S. When the second tray 22 is in the open position, the second tray surface 22B is continuous with the first tray surface 21D of the first tray 21 in the second open position.

When the image scanner 1 is placed on a horizontal surface and the second tray 22 is in the open position, a direction perpendicular to the second tray surface 22B has a vertically upward component.

As illustrated in FIG. 5, the length L1 of the first tray surface 21D in a sheet conveyance direction is smaller than the length L2 of the second tray surface 22B in the conveyance direction. For example, the sheet conveyance direction may correspond to a direction in which a sheet S is fed by a feed roller 41. As further illustrated in FIG. 5, the first tray surface, second tray surface and chute surface may be disposed along the sheet conveyance direction.

Figure 9:
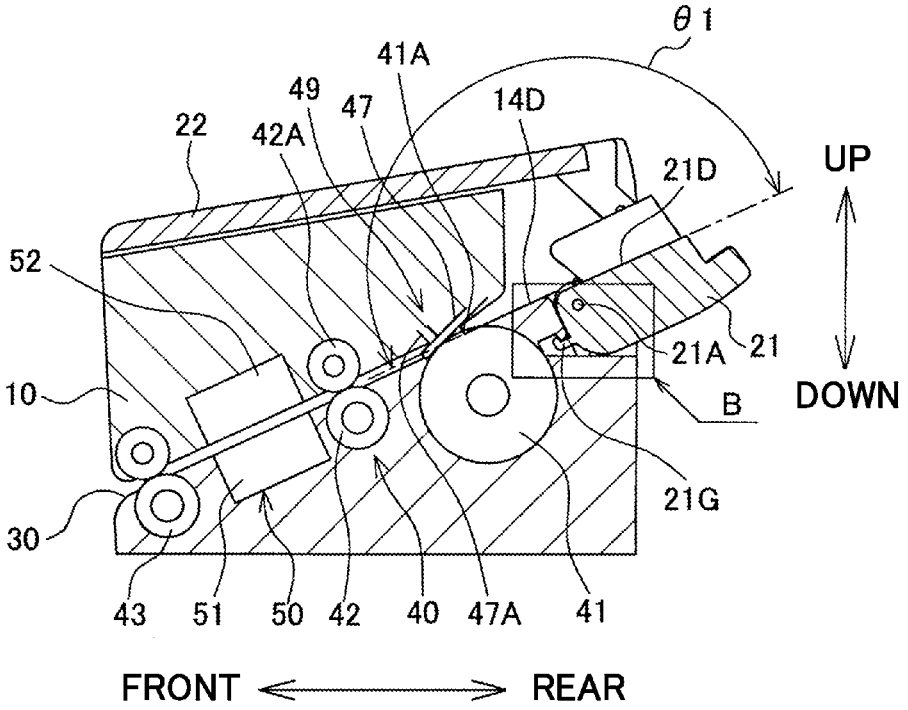
FIG. 9 is a side sectional view of the image scanner according to the example embodiment.

When the second tray 22 is in the closed position and the first tray 21 is in the first open position as illustrated in FIG. 9, the end portion 21I of the first tray 21 is engaged with the engagement recess 10C of the housing 10 and the lower end surface 21J of the first tray 21 is in contact with the contact surface 10D of the housing 10 as illustrated in FIG. 10. As a result, and as illustrated in FIG. 9, the first tray 21 in the first open position is engaged with the housing 10, and the position of the first tray 21 is fixed. The first tray surface 21D of the first tray 21 in the first open position forms a first angle θ1 with the lower guide surface 14D of the chute 14. The first angle θ1 is, for example, obtuse angle. When the first angle θ1 is obtuse angle, the conveyance path P is defined by the first tray surface 21D and the lower guide surface 14D. On the other hand, when the first angle θ1 is not obtuse angle, the conveyance path P is not defined by the first tray surface 21D and the lower guide surface 14D. The first angle θ1 is, for example, in the range of 175 to 180 degrees. When the first angle θ1 is in the range of 175 to 180 degrees, the first tray surface 21D and the lower guide surface 14D may define a straight conveyance path P. In one arrangement, the first angle θ1 is 180 degrees.

Figure 7:
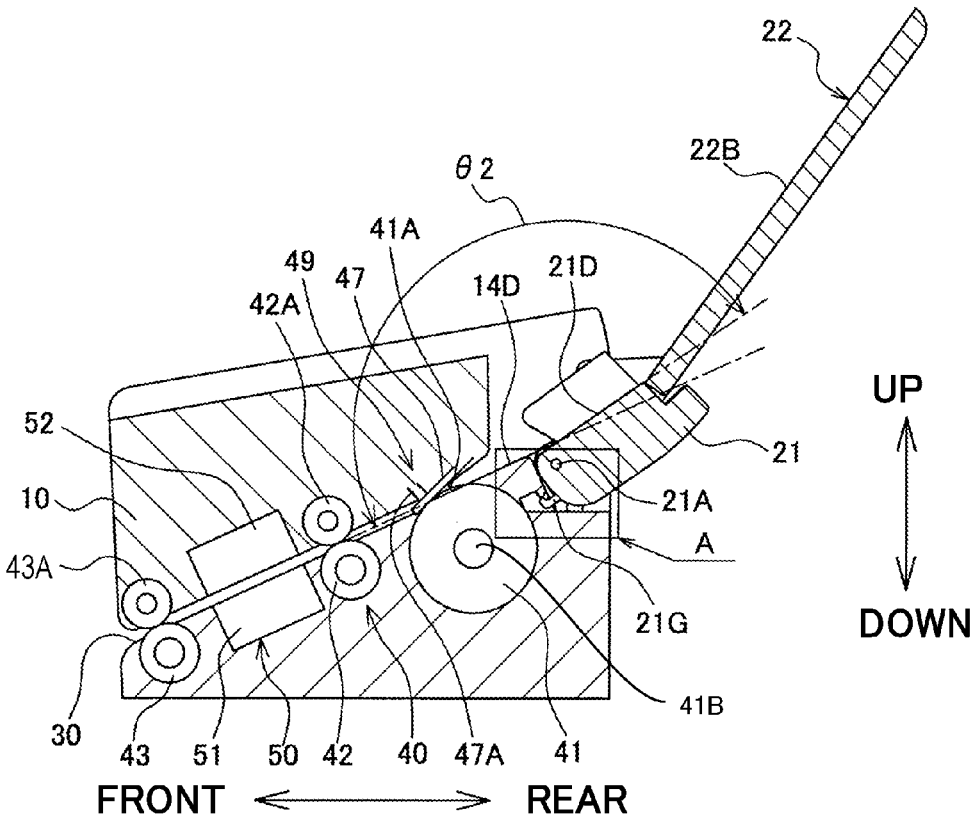
FIG. 7 is a side sectional view of the image scanner according to the example embodiment.

When the second tray 22 is in the open position and the first tray 21 is in the second open position as illustrated in FIG. 7, the end portion 21I of the first tray 21 is in contact with the engagement protrusion 10B of the housing 10 as illustrated in FIG. 8. The first tray 21 contacts the second tray 22 in the open position due to a biasing force of the torsion spring 21B. As illustrated in FIG. 7, the first tray surface 21D of the first tray 21 in the second open position is located between and continuous with the lower guide surface 14D of the chute 14 and the second tray surface 22B of the second tray 22. The first tray surface 21D of the first tray 21 in the second open position forms a second angle θ2, which is smaller than the first angle θ1, with the lower guide surface 14D of the chute 14. The second angle θ2 is, for example, obtuse angle. When the second angle θ2 is obtuse angle and the second tray 22 is in the open position, the conveyance path P is defined by the second tray surface 22B, the first tray surface 21D, and the lower guide surface 14D. On the other hand, when the second angle θ2 is not obtuse angle, the conveyance path P is not defined by the second tray surface 22B, the first tray surface 21D, and the lower guide surface 14D. The second angle θ2 is, for example, in the range of 165 to 175 degrees. In one arrangement, the second angle θ2 is 170 degrees.

1.3. Structure of Output Section 30

As illustrated in FIGS. 1 and 2, the output section 30 is an opening in a lower front part of the housing 10, which is formed because the upper cover 11 and the back cover 12 are spaced apart (e.g., disposed with a space therebetween). The output section 30 outputs a sheet S that has been conveyed along the conveyance path P.

1.4. Structure of Conveyance Mechanism 40

As illustrated in FIGS. 4 to 6, the conveyance mechanism 40 includes the feed roller 41, a separation unit 49, a LF (line feed) roller 42, and an ejecting roller 43, which are arranged in this order from upstream to downstream along the conveyance path P.

A sheet feeding unit such as the feed roller 41 is mounted in the chute 14. A roller surface 41A of the feed roller 41 is exposed to the conveyance path P and protrudes from the lower guide surface 14D of the conveyance guide 14A. The roller surface 41A of the feed roller 41 contacts a sheet S that is conveyed along the conveyance path P.

The feed roller 41, which is driven by a driving unit (not shown), rotates about rotation axis 41B (as shown FIG. 7). The feed roller 41 rotates in contact with a sheet S that is placed on the first tray surface 21D and the second tray surface 22B, thereby feeding the sheet S downstream in the conveyance direction.

The separation unit 49 includes a separation pad 47. The separation pad 47 is a plate-shaped member made of rubber, an elastomer, or the like. The separation unit 49 is attached to the upper cover 11. In the state in which the separation unit 49 is attached to the upper cover 11, the separation pad 47 faces the feed roller 41. When the upper cover 11 is closed, the separation pad 47 is biased by a pressing portion 47A and pressed against the feed roller 41. Thus, the separation pad 47 nips sheets S, which are conveyed along the conveyance path P, with the feed roller 41 and further separates the sheets S one by one.

Transport units such as the LF roller 42 and the ejecting roller 43 may each be mounted in the chute 14 and located at the conveyance guide 14A. As illustrated in FIG. 5, the sum of the length L1 and the length L3 is greater than or equal to the length L4. The length L1 is a length of the first tray surface 21D in the conveyance direction. The length L3 is a length from an end of the first tray surface 21D near the feed roller 41 to the feed roller 41 in the conveyance direction. The length L4 is a length from the feed roller 41 to the LF roller 42 in the conveyance direction. The LF roller 42 and the ejecting roller 43 are driven by a driving unit (not shown) and rotate in a same conveyance direction as that of the feed roller 41.

A driven roller 42A is disposed above the LF roller 42 so as to face the LF roller 42. The driven roller 42A is mounted in the upper cover 11. The driven roller 42A is biased by a biasing member (not shown) and pressed against the LF roller 42. Thus, the LF roller 42 rotates while nipping a sheet S, which is conveyed along the conveyance path P, with the driven roller 42A and conveys the sheet S downstream in the conveyance direction.

A driven roller 43A is disposed above the ejecting roller 43 so as to face the ejecting roller 43. The driven roller 43A is mounted in the upper cover 11. The driven roller 43A is biased by a biasing member (not shown) and pressed against the ejecting roller 43. Thus, the ejecting roller 43 rotates while nipping a sheet S, which is conveyed along the conveyance path P, with the driven roller 43A and ejects the sheet S to the output section 30, which is disposed downstream in the conveyance direction.

1.5. Structure of Image Scanning Unit 50

As illustrated in FIGS. 4 to 6, a sheet processing unit such as the image scanning unit 50 may process sheets such as sheet S fed by the feed roller 41. Image scanning unit 50 includes a first scanning unit 51 and a second scanning unit 52. The first scanning unit 51 and the second scanning unit 52 are located downstream from the LF roller 42 in the conveyance direction and upstream from the ejecting roller 43 in the conveyance direction. The first scanning unit 51 is mounted in the upper cover 11. The second scanning unit 52 is mounted in the chute 14. For example, the first scanning unit 51 and the second scanning unit 52 face each other vertically with the conveyance path P defined therebetween. A contact image sensor (CIS), a charge coupled device (CCD), or the like may be used as the first scanning unit 51 and the second scanning unit 52.

2. Operation of Image Scanner 1

Next, the operation of the image scanner 1 will be described.

(1) In the case where only the first tray 21 is used, the first tray 21 is rotated from the position shown in FIG. 4, in which the first tray 21 is in the first closed position and the second tray 22 is in the closed position, to the first open position. As illustrated in FIG. 8, when the first tray 21 is in the second open position, the end portion 21I of the first tray 21 is in contact with the engagement protrusion 10B of the housing 10. When the first tray 21 is rotated from the second open position to the first open position, the end portion 21I is pressed by the engagement protrusion 10B of the housing 10 in the radial direction of the first rotation axis 21A. The end portion 21I, which has been pressed, enters the engagement recess 10C. The end portion 21I, upon entering the engagement recess 10C, becomes engaged with the engagement recess 10C. When the first tray 21 is moved to the first open position, the lower end surface 21J of the first tray 21 contacts the contact surface 10D of the housing 10. When the end portion 21I is engaged with the engagement recess 10C and the lower end surface 21J is in contact with the contact surface 10D, rotation of the first tray 21 beyond the first open position is restricted. The first tray 21 in the first open position is engaged with the housing 10.

When the first tray 21 is in the first open position, the first tray surface 21D of the first tray 21 forms an angle of, for example, 180 degrees with the lower guide surface 14D of the chute 14.

When a high-rigidity sheet is placed on the first tray 21 and fed by the feed roller 41, the sheet S is conveyed while maintaining a state in which the sheet S extends in the conveyance direction, so that variation in conveyance speed is suppressed and a decrease in the feed performance is suppressed.

Examples of a high-rigidity sheet include a business card, a cash card, a membership card, and a driver's license card. The length of a short side of such a card is, for example, 53.98 mm according to an international standard ID-1 of International Organization for Standardization (ISO)/International Electrotechnical Commission (IEC). The length of a long side of such a card is, for example, 85.60 mm according to the international standard ID-1 of International Organization for Standardization (ISO)/International Electrotechnical Commission (IEC).

(2) In the case where the first tray 21 and the second tray 22 are used, the second tray 22 is rotated from the position shown in FIG. 4, in which the first tray 21 is in the first closed position and the second tray 22 is in the closed position, to the open position. As illustrated in FIG. 6, when the second tray 22 is rotated from the closed position to the open position, the first tray 21, which is in contact with the second tray 22, rotates from the first closed position to the second open position in accordance with the rotation of the second tray 22. When the first tray 21 rotates to the second open position, the end portion 21I of the first tray 21 contacts the engagement protrusion 10B of the housing 10. Thus, the first tray 21 is moved to the second open position, and the second tray 22 is moved to the open position. As a result, the first tray surface 21D of the first tray 21 is located between and continuous with the lower guide surface 14D of the chute 14 and the second tray surface 22B of the second tray 22. The first tray surface 21D forms the second angle 82 with the lower guide surface 14D.

When low-rigidity sheets are stacked on the first tray 21 and the second tray 22 and fed by the feed roller 41, a force is applied to the stack of the sheets S on the first tray 21 and the second tray 22 in the conveyance direction due to the weight of the sheets S. As a result, a load applied to sheets S in a lower part of the stack is decreased. Therefore, friction between sheets S that are in contact with each other is reduced, and a lower sheet of the sheets S can be easily separated from an upper sheet of the sheets S. Examples of a low-rigidity sheet include a sheet of paper, a transparency sheet, or the like.

(3) Image Scanning Operation

When a sheet S is loaded and an instruction to scan an image of the sheet S is input, a controller controls the feed roller 41 to convey the sheet S on the lower guide surface 14D in the conveyance direction. The controller includes a CPU, a ROM, a RAM, which are mounted on a circuit board (not shown). At this time, if a plurality of overlapping sheets S are about to be fed, friction is generated between the separation pad 47 and the sheets S, so that the sheets S are separated one by one.

The LF roller 42 conveys the sheet S, which has been separated, to the image scanning unit 50. In the image scanning unit 50, the first scanning unit 51 and the second scanning unit 52 scan images on both sides of the sheet S. Signals output from the first scanning unit 51 and the second scanning unit 52 are sent to the controller and converted to image data. Then, the ejecting roller 43 ejects the sheet S, whose images have been scanned, to the output section 30.

3. Advantages of Embodiment (1) With the image scanner 1 according to aspects described herein, a card, which is relatively rigid and small, may be placed on the first tray surface 21D, which is smaller than the second tray 22, while the second tray 22 is in the closed position. As a result, the second tray 22, which is longer than the first tray 21, is not in the open position, so that the size of the space required by the image scanner 1 can be reduced/minimized.

(2) In many instances, an image scanner may include a feed tray having an inclination angle with respect to the horizontal direction. In this case, a force is applied to a stack of sheets in the conveyance direction due to the weight of the sheets, and a load applied to a lower part of the stack is decreased. As a result, friction between sheets that are in contact with each other is reduced and a lower sheet can be easily separated from an upper sheet.

A conveyance path may extend in the horizontal direction. In this case, a sheet jam due to a sheet that has been output by a sheet output unit is not likely to occur, and the sheet output unit can efficiently output sheets.

In the case where the feed tray has an inclination angle with respect to the horizontal direction and the conveyance path extends in the horizontal direction, an extension surface of the tray surface of the feed tray intersects an extension surface of a chute surface of a chute.

However, in the case where the extension surfaces of the chute surface and the tray surface intersect each other, and when a sheet having rigidity, such as a card, is conveyed, the sheet is not easily deformed so as to follow the chute surface and the tray surface. Therefore, when the sheet is nipped between the feed roller and a LF roller pair, the sheet applies a large repulsive force to the LF roller pair. The LF roller pair is disposed downstream from the feed roller. The LF roller pair may include a drive roller, which is driven by a motor or the like, and a driven roller, which is rotated by the drive roller and biased against the drive roller. Due to the repulsive force, the sheet, which has rigidity, might not be appropriately nipped. As a result, conveyance performance may deteriorate or decrease. For example variation in the conveyance speed may increase.

Moreover, in some instances, the precision of separation decreases and the conveyance performance may decrease due to an increase in the repulsive force applied to the feed roller.

In contrast, with the image scanner 1 according to aspects described herein, in the case where only the first tray 21 is used, and when the first tray 21 located in the first open position, the first tray surface 21D of the first tray 21 forms an angle of nearly 180 degrees with the lower guide surface 14D of the chute 14. In this state, when a high-rigidity sheet is placed on the first tray 21 and fed by the feed roller 41, the sheet S is conveyed while maintaining a position in which the sheet S extends in the conveyance direction, so that variation in conveyance speed and decrease in the conveyance performance are suppressed.

In the case where both of the first tray 21 and the second tray 22 are used, the second tray 22 is disposed in the open position and the first tray 21 is disposed in the second open position. In this state, the first tray surface 21D of the first tray 21 is located between and continuous with the lower guide surface 14D of the chute 14 and the second tray surface 22B of the second tray 22. The first tray surface 21D forms a second angle θ2 with the lower guide surface 14D. In this state, when low-rigidity sheets S are stacked on the first tray 21 and the second tray 22, a force is applied to the stack of sheets S in the conveyance direction due to the weight of the sheets S and a load applied to the sheets S in a lower part of the stack is decreased, so that friction between sheets S that are in contact with each other is decreased and a lower one of the sheets S can be easily separated from an upper one of the sheets S. Accordingly, it is possible for the image scanner 1 to convey both high-rigidity sheets and low-rigidity sheets.

(3) With the image scanner 1 according to the aspects described herein, the first tray 21 is biased from the first open position toward the first closed position due to a biasing force of the torsion spring 21B, which is fitted onto the first rotation shaft. Thus, by only rotating the second tray 22 from the closed position to the open position, the first tray 21 can be rotated from the first closed position to the second open position. Accordingly, it is not necessary to rotate the first tray 21 and the second tray 22 independently, and convenience for a user can be improved.

(4) With the image scanner 1 according to the aspects described herein, when the first tray 21 is in the first open position, the end portion 21I of the extension portion 21H of the first tray 21 is engaged with the engagement recess 10C of the housing 10. Thus, the first tray 21, which is biased from the first open position toward the first closed position, can be maintained in the first open position.

(5) With the image scanner 1 according to the aspects described herein, the first tray 21 is attached to the back end of the housing 10 so as to be rotatable around the first rotation axis 21A, which extends in the left-right direction. The second tray 22 is attached to an upper part of the back end of the housing 10 so as to be rotatable around the second rotation axis 22A, which extends in the left-right direction. Thus, the first tray 21 and the second tray 22 can be rotated with a simple structure.

(6) With the image scanner 1 according to the aspects described herein, the length L1 of the first tray surface 21D in the conveyance direction is smaller than the length L2 of the second tray surface 22B in the conveyance direction. Thus, the size of the image scanner 1 can be reduced.

(7) With the image scanner 1 according to aspects described herein, the side guides 21E and 21F can be slid along the first tray surface 21D of the first tray 21 in the left-right direction. The side guides 21E and 21F are disposed on the first tray surface 21D with a space therebetween in the left-right direction. Thus, it is possible to align sheets S in both of the following cases: a case where the first tray 21 is displaced to the first open position and the sheets S are placed only on the first tray 21; and a case where the first tray 21 is displaced to the second open position, the second tray 22 is displaced to the open position, and the sheets are placed on the first tray 21 and the second tray 22.

(8) With the image scanner 1 according to the aspects described herein, the sum of the length L1 and the length L3 is greater than or equal to the length L4. The length L1 is a length of the first tray surface 21D in the conveyance direction. The length L3 is a length from an end of the first tray surface 21D near the feed roller 41 to the feed roller 41 in the conveyance direction. The length L4 is a length from the feed roller 41 to the LF roller 42 in the conveyance direction. Thus, in a case where a high-rigidity sheet placed on the first tray surface 21D is conveyed, the sheet can be easily conveyed by at least one of the feed roller 41 and the LF roller 42. As a result, the probability that the sheet S is not conveyed by any of the feed roller 41 and the LF roller 42 is reduced, so that a high-rigidity sheet placed on the first tray surface 21D can be more reliably conveyed.

(9) With the image scanner 1 according to the aspects described herein, when the second tray 22 is in the open position, a direction perpendicular to the second tray surface 22B has a vertically upward component. Thus, sheets S that are stacked on the first tray 21 in the second open position and the second tray 22 in the open position can be more easily pressed against the first tray 21 and the second tray 22 due to the weight of the sheets S. As a result, the sheets S can be more stably supported on the first tray 21 and the second tray 22, so the sheets S can be conveyed more reliably.

(10) With the image scanner 1 according to aspects described herein, the image scanning unit 50 is disposed downstream from the LF roller 42 in the conveyance direction. The image scanning unit 50 is an example of a sheet processing unit that processes a sheet S that is fed by the LF roller 42. Thus, processing of a sheet fed by the LF roller 42, such as scanning an image of the sheet, can be performed with higher precision.

4. Other Embodiments

The present disclosure is not limited to the embodiment described above and can be implemented in various ways as follows.

(1) Aspects described herein can be applied to an apparatus other than an image scanner, as long as the apparatus includes a sheet feeder function. For example, aspects described herein can be applied to an image forming apparatus, such as a laser printer or an inkjet printer.

(2) The first tray 21 may not rotate around the first rotation axis 21A extending in the left-right direction and as in the embodiment described above. For example, the first tray 21 may be slid in the front-back direction while changing its inclination angle. In the sliding mechanism, when the second tray 21, slid from the first closed position, is in the second open position, the inclination angle is the aforementioned first angle θ2. When the first tray 21, slid from the second open position, is in the first open position, the inclination angle is the aforementioned first angle θ1. Likewise, for example, the second tray 22 may be slid in the front-back direction while changing its inclination angle.

(3) The first tray 21 may be deformable between the first open position and the second open position.

(4) The first tray 21 might not be biased by the torsion spring 21B as in the embodiment described above. For example, the first tray 21 may be biased by a plate spring.

(5) The first tray 21 might not become engaged with the housing 10 as in the embodiment described above.

(6) The conveyance guide 14A of the chute 14 might not have a flat plate-like shape as in the embodiment described above.

Figure 13:
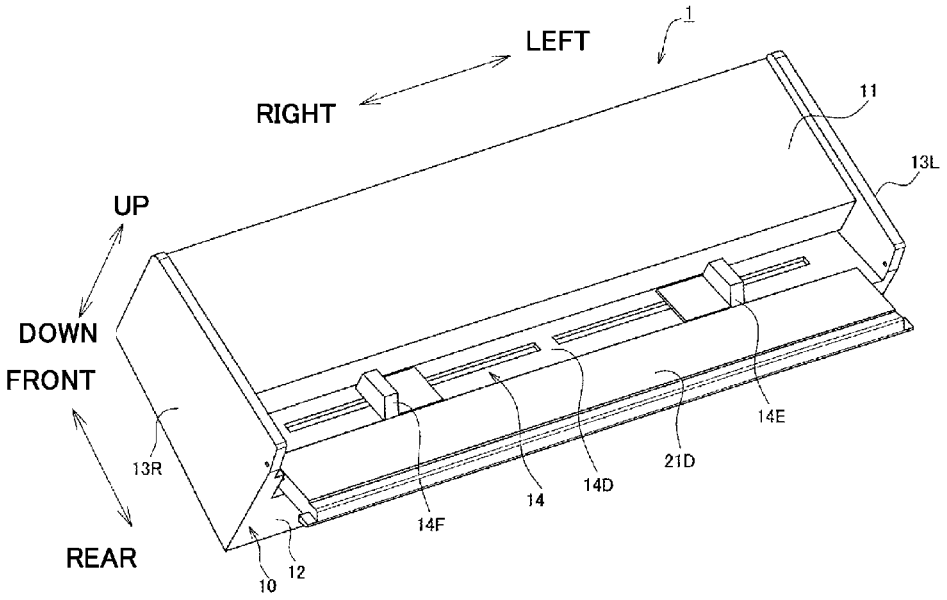
FIG. 13 is a perspective view of an image scanner according to another example embodiment in a state in which a first tray is open.

(7) The side guides 21E and 21F may not be attached to the first tray surface 21D. For example, as illustrated in in FIG. 13, side guides 14E and 14F may be attached to the lower guide surface 14D of the chute 14. In FIG. 13, the second tray 22 and the second tray stoppers 13LA and 13RA are not illustrated. The side guides 14E and 14F are disposed with a space therebetween in the left-right direction. The side guides 14E and 14F can be slid along the lower guide surface 14D in the left-right direction. The side guides 14E and 14F are configured to be simultaneously slid in opposite directions. Alternatively, a pair of side guides may be attached to each of the first tray surface 21D and the lower guide surface 14D.

What is claimed is:

1. A sheet feeder comprising:

a chute comprising a sheet feeding unit protruding from a chute surface;

a first tray having a first tray surface and movable to a first open position and a second open position; and a second tray having a second tray surface and movable between a closed position and an open position, wherein, when the second tray is in the closed position and the first tray is in the first open position, the first tray surface forms a first angle with the chute surface, and wherein, when the second tray is in the open position and the first tray is in the second open position, the first tray surface is located between the chute surface and the second tray surface, and forms a second angle with the chute surface, the second angle being smaller than the first angle, and the first and second angles are obtuse angles.

2. The sheet feeder according to claim 1, further comprising:

a spring biasing the first tray from the first open position toward a first closed position, wherein the first tray is movable to the first closed position, the first open position, and the second open position, and wherein the first tray is configured to be positioned in the second open position by contacting the second tray in the open position and by the spring biasing the first tray from the first open position toward the first closed position.

3. The sheet feeder according to claim 2, further comprising a housing including the chute, wherein a position of the first tray is fixed by the first tray engaging with the housing when the first tray is in the first open position.

4. The sheet feeder according to claim 2, further comprising:

a first engaging member provided in the first tray; and a second engaging member provided in the housing, wherein the first engaging member engages with the second engaging member when the first tray is in the first open position.

5. The sheet feeder according to claim 4, wherein the second engaging member comprises a recess recessed toward the chute surface, and wherein the first engaging member comprises an end portion protruding toward the chute surface when the first tray is in the first open position, the end portion disposed within the recess when the first tray is in the first open position.

6. The sheet feeder according to claim 2, wherein the first tray is configured to rotate around a first rotation axis between the first closed position and the first open position, through the second open position, and wherein the second tray is configured to rotate around a second rotation axis from the closed position to the open position, the second rotation axis being different from the first rotation axis.

7. The sheet feeder according to claim 6, wherein the first tray and the second tray are each rotatably connected to a housing including the chute.

8. The sheet feeder according to claim 1, wherein at least one of the first tray and the chute includes a first side guide and a second side guide, the first side guide being movable in a direction perpendicular to a sheet conveyance direction along the first tray surface, second tray surface, and chute surface, and parallel to the first tray surface.

9. The sheet feeder according to claim 1, wherein a first length from a first end to a second end of the first tray surface in a sheet conveyance direction along the first tray surface, second tray surface, and chute surface, is smaller than a second length from a first end to a second end of the second tray surface in the sheet conveyance direction.

10. The sheet feeder according to claim 9, wherein the chute further comprises a transport unit arranged in a downstream of the sheet feeding unit in a sheet conveyance direction along the first tray surface, second tray surface, and chute surface, and wherein a sum of the first length and a third length is greater than or equal to a fourth length, the third length being a length from an end of the first tray surface nearest to the sheet feeding unit to the sheet feeding unit in the sheet conveyance direction, and the fourth length being a length from the sheet feeding unit to the transporting unit in the sheet conveyance direction.

11. The sheet feeder according to claim 1, wherein, when the second tray is in the closed position and the first tray is in the first open position, the first tray surface and the chute surface define a straight conveyance path.

12. The sheet feeder according to claim 11, wherein the first angle is 180 degrees.

13. The sheet feeder according to claim 1, wherein the second tray surface inclines upwardly when the second tray is in the open position.

14. The sheet feeder according to claim 1, further comprising:

a sheet processing unit configured to process a sheet and arranged downstream of the sheet feeding unit in a sheet conveyance direction along the first tray surface, second tray surface and chute surface.

15. The sheet feeder according to claim 14, wherein the sheet processing unit is an image scanning unit configured to scan an image of the sheet fed by the sheet feeding unit.

16. A sheet feeder comprising:

a housing having a chute surface;

a feed roller having a surface protruding from the chute surface;

a first tray rotatably connected to the housing, the first tray being rotatable between a first closed position and a first open position around a first rotation axis, the first rotation axis being parallel to an axis of the feed roller, the first tray being located closer to the housing in the first closed position than when the first tray is located in the first open position, and the first tray being biased toward the housing and being engaged with the housing when the first tray is in the first open position; and a second tray rotatably connected to the housing, the second tray being rotatable between a closed position and an open position around a second rotation axis, the second rotation axis being parallel to the axis of the feed roller and different from the first rotation axis, the second tray being located closer to the housing in the closed position than when the second tray is in the open position, and the second tray being in contact with the first tray and causing the first tray to be located in a second open position between the first open position and the first closed position when the second tray is in the open position, wherein a first length from a first end to a second end of a first tray surface in a sheet conveyance direction along the first tray surface, second tray surface and chute surface is smaller than a second length from a first end to a second end of the second tray surface in the sheet conveyance direction.

* * * * *